US005649266A

United States Patent [19]

Rushing

[11] Patent Number: 5,649,266

[45] Date of Patent: Jul. 15, 1997

[54] IN-STATION CALIBRATION OF TONER CONCENTRATION MONITOR AND REPLENISHER DRIVE

[75] Inventor: Allen Joseph Rushing, Webster, N.Y.

[73] Assignee: Eastman Kodak Company, Rochester, N.Y.

[21] Appl. No.: 635,867

[22] Filed: Apr. 18, 1996

[51] Int. Cl.[6] ..... G03G 15/10

[52] U.S. Cl. ..... 399/59; 118/689

[58] Field of Search ..... 399/58, 59, 62; 118/689

[56] References Cited

U.S. PATENT DOCUMENTS

| | | |
|---|---|---|
| 4,026,643 | 5/1977 | Bergman . |
| 4,916,488 | 4/1990 | Kimura . |
| 5,091,749 | 2/1992 | Iida et al. . |
| 5,166,730 | 11/1992 | Urabe . |
| 5,311,261 | 5/1994 | Nakagama et al. . |
| 5,559,579 | 9/1996 | Gwaltney et al. . |

*Primary Examiner*—Robert Beatty
*Attorney, Agent, or Firm*—Norman Rushefsky

[57] ABSTRACT

A method is described of determining a sensitivity parameter of a toner monitor that forms a part of an electrostatographic recording apparatus having a development station that includes a mixture of a toner material in a toner developer composition wherein concentration of the toner material in the composition tends to change with use of the apparatus in making copies or prints. The method comprises providing in the development station a known weight or concentration of toner material as an initial condition of weight or concentration of toner material. The toner monitor generates a first signal representing a first output voltage of the toner monitor for the initial condition of weight or concentration of toner material. The electrostatographic recording apparatus is operated in a recording mode wherein the predetermined weight or concentration of toner material in the development station is reduced by a predetermined amount. The toner monitor generates a second signal representing a second output voltage of the toner monitor for the recording mode. There is then calculated a sensitivity parameter of the toner monitor in response to the first signal and the second signal. There is also described a method of determining gain of a toner replenishment device that forms a part of said apparatus, the method of determining gain comprises the steps of, after the recording mode, operating the toner replenishment device to deliver toner to the development station without toning any images; determining the time of operation of the toner replenishment device required to generate a third output voltage of the toner monitor equal to the first output voltage and calculating gain of the toner replenishment device by dividing the predetermined amount by said time.

10 Claims, 8 Drawing Sheets

IN-STATION CALIBRATION OF TONER CONCENTRATION MONITOR AND REPLENISHER DRIVE

CROSS-REFERENCE TO RELATED APPLICATION

This application is related to U.S. application Ser. No. 08/629,693, filed on Apr. 19, 1996, in the names of Allen J. Rushing and Peter S. Alexandrovich and entitled "Apparatus and Method for Regulating Toning Contrast and Extending Developer Life by Long-Term Adjustment of Toner Concentration."

BACKGROUND OF THE INVENTION

1. Field of the Invention

This invention relates to the field of electrostatography, and more particularly, to improvements in a method for controlling toner replenishment.

2. Description of the Prior Art

Toning stations for electrophotographic copiers and printers typically have two-component developer mixtures (carrier and toner). Toner depleted by toning latent images on the photoconductor must be replaced by replenishing with new toner, so that the toner concentration (TC) remains within a usable range in the toning station developer mix.

Closed-loop toner concentration control, for example, see U.S. Pat. No. 4,875,078, is typically achieved by means of a TC monitor, and control logic to drive a toner replenishment mechanism. TC monitors are of several types, including optical and magnetic. A limitation on the performance of such TC monitors is that their sensitivity varies greatly from unit to unit and over age. Mounting variability of the sensor probe on the development station as well as variability in the sensor probe itself contributes to overall variability. Another limitation is in the replenisher mechanism, where again there is substantial variability in toner delivery rate (gain), unit to unit and over time. Current practice is to adjust the monitor output, $V_{MON}$, to 2.500 V when a new load of developer at nominal 10% concentration is installed in the development station. The replenishment algorithm then acts to regulate $V_{MON}$ to this initial 2.500 V value. Maintaining $V_{MON}$=2.500 V assures that TC=10% (barring monitor drift) regardless of TC monitor sensitivity.

With reference now to FIG. 7, there is shown a schematic of an electrophotographic copier/printer apparatus of the prior art having one form of control system for replenishing toner taken out during the reproduction cycle. The apparatus 10 comprises a moving belt 18 entrained about rollers 11–17, one of which is driven by a motor M to drive the belt in the direction indicated by the arrow. A corona charger 19 provides a uniform electrostatic charge on the belt. An electro-optical exposure source 20 exposes the belt to form an electrostatic image that is developed with toner particles from a station 22. The developed image is then transferred to a sheet S at a transfer station 24 and the toner image is fused to the sheet by fusing rollers 26. In order to control the concentration of toner particles in the developer mix (magnetic carrier particles plus non-magnetic toner particles) a toner concentration monitor 30 is provided having a probe 30*a* mounted either inside or outside of the development station's housing 22. In response to toner concentration as sensed by the probe, a signal $V_{MON}$ is generated by the TC monitor 30. In the prior art, the TC monitor outputs a signal $V_{MON}$ in accordance with an assumed or nominal sensitivity ($S_{NOMINAL}$) having the parametric relationship of $V_{MON}$ to TC illustrated in the accompanying FIG. 8. The signal $V_{MON}$ output by the TC monitor 30 is then compared with the set point of 2.5 volts and an error signal E is generated that may be input to a replenishment motor control unit 32 which controls the duty cycle of a replenishment motor 34. The motor 34 drives a toner auger 36 that feeds replenishment toner into the development station 22. The toner is mixed with the carrier particles in the development station by suitable mixing blades as is well known to obtain a uniform mixture. As noted in U.S. Pat. No. 4,875,078, improvements in control of toner concentration may be provided by providing a proportional plus integral control of the error signal E. In any event, a closed loop control of toner concentration is provided. In order to guard against harmful extremes of TC, upper and lower limits are set for $V_{MON}$ (see $V_{MON1}$ and $V_{MON2}$). The corresponding values for TC, however, depend on the actual sensitivity and not those derived using the nominal sensitivity parametric relationship illustrated in FIG. 2. So the limits on $V_{MON}$ are set to accommodate the worst case, and are reached prematurely for the nominal toner monitor sensitivity. Another problem arises when it is desirable to change TC from the nominal 10% at setup. This may be done by changing the aim voltage in the replenisher algorithm from the initial 2.500 to a new value. The actual TC corresponding to the new $V_{MON}$ aim value depends on the actual parametric relationship between TC and $V_{MON}$ or actual sensitivity. Given the wide distribution of possible actual sensitivity values, there is a substantial likelihood of error in forming the new intended TC aim point.

The logic of the TC control algorithm is typically designed for a nominal monitor sensitivity and replenisher gain. Departure from these nominal values degrades the accuracy of the TC regulation. Alternatively, the algorithm may be designed to assure acceptable performance with extreme values of monitor sensitivity and/or replenisher gain, at some sacrifice of performance with nominal values.

SUMMARY OF THE INVENTION

It is, therefore, an object of the invention to provide improved control over TC. Improved TC control is obtained by reducing the uncertainty in monitor sensitivity and replenisher gain. This is done by a novel automatic calibration procedure.

In accordance with one aspect of the invention, there is provided a method of determining a sensitivity parameter of a toner monitor that forms a part of an electrostatographic recording apparatus having a development station that includes a mixture of a toner material in a toner developer composition wherein concentration of the toner material in the composition tends to change with use of the apparatus in making copies or prints, the method comprising (a) providing in the development station a known weight or concentration of toner material as an initial condition of weight or concentration of toner material; (b) generating a first signal representing a first output voltage of the toner monitor for the initial condition of weight or concentration of toner material; (c) operating the electrostatographic recording apparatus in a recording mode wherein the predetermined weight or concentration of toner material in the development station is reduced by a predetermined amount; (d) generating a second signal representing a second output voltage of the toner monitor for the recording mode; and (e) calculating a sensitivity parameter of the toner monitor in response to the first signal and the second signal.

In accordance with a second aspect of the invention, there is provided a method of determining a gain parameter of a toner replenishment device that forms a part of an electrostatographic recording apparatus having a development station that includes a mixture of a toner material in a toner developer composition wherein concentration of the toner material in the composition tends to change with use of the apparatus in making copies or prints and wherein concentration of the toner material in the composition is monitored by a toner monitor, the method comprising (a) providing in the development station a known weight or concentration of toner material as an initial condition of weight or concentration of toner material; (b) generating a first signal representing a first output voltage of the toner monitor for the initial condition of weight or concentration of toner material; (c) operating the electrostatographic recording apparatus in a recording mode wherein the predetermined weight or concentration of toner material in the development station is reduced by a predetermined amount; (d) operating the toner replenishment device to deliver toner to the development station; (e) determining the time of operation of the toner replenishment device required to generate a third output voltage of the toner monitor equal to the first output voltage; and (f) calculating gain of the toner replenishment device by dividing the predetermined amount by said time.

The invention and its various advantages will become more apparent to those skilled in the art from the ensuing detailed description of preferred embodiments, reference being made to the accompanying drawings.

BRIEF DESCRIPTION OF THE DRAWINGS

The subsequent description of the preferred embodiments of the present invention refers to the attached drawings, wherein:

FIGS. 4A and 4B are a flowchart of the process for deriving a development station replenishment control signal for the machine of FIG. 1;

DESCRIPTION OF THE PREFERRED EMBODIMENT

Because apparatus of the general type described herein are well known the present description will be directed in particular to elements forming part of, or cooperating more directly with, the present invention.

To facilitate understanding of the foregoing, the following terms are defined:

$V_B$=Development station electrode bias.

$V_0$=Primary voltage (relative to ground) on the photoconductor just after the charger. This is sometimes referred to as the "initial" voltage.

$V_F$=Photoconductor voltage (relative to ground) just after exposure.

$E_0$=Light produced by the print head.

E=Actual exposure of photoconductor. Light $E_0$ produced by the print head illuminates the photoconductor and causes a particular level of exposure E of the photoconductor.

In general contrast and density control are achieved by the choice of the levels of $V_0$, $E_0$, and $V_B$ as is well known and described in the published literature.

Another term used herein is "toning contrast", by which is meant the ratio of the output density D to the absolute value of the difference between $V_B$ and $V_F$ corresponding preferably to a region of density less than maximum although the invention contemplates use of regions of maximum density. A more precise value of toning contrast is obtained by first subtracting from the measured value $V_F$ an expected value, $D_d$, representing "dark decay" between electrometer measurement and toning. Since there will be a small time lapse between when an exposed photoconductive recording member is measured by the electrometer and when it reaches the toning zone, the $V_F$ for toning will not be identical with measured $V_F$ and the difference may be attributed to dark decay and the expected value thereof approximated. The term "toning contrast" as generally referred to herein contemplates use of either the more precise or the less precise calculated values for toning contrast.

Figure 1:
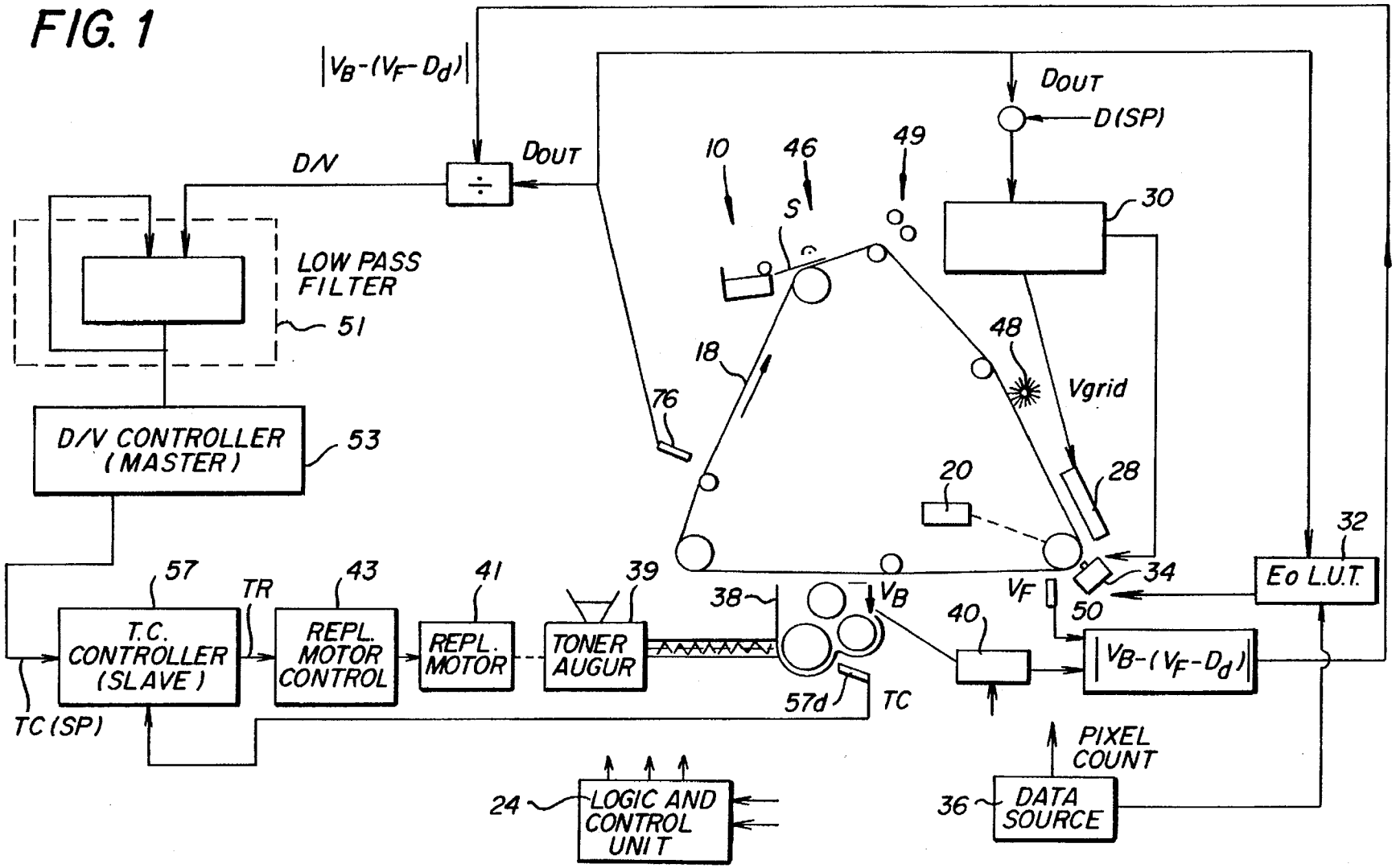
FIG. 1 is a schematic showing a side elevational view of an electrostatographic machine that is used in accordance with a preferred embodiment of the invention.

With reference to the machine 10 as shown in FIG. 1, a moving recording member such as photoconductive belt 18 is driven by a motor 20 past a series of work stations of the printer. A logic and control unit (LCU) 24, which has a digital computer, has a stored program for sequentially actuating the work stations.

Briefly, a charging station 28 sensitizes belt 18 by applying a uniform electrostatic charge of predetermined primary voltage $V_0$ to the surface of the belt. The output of the charger is regulated by a programmable controller 30, which is in turn controlled by LCU 24 to adjust primary voltage $V_0$ for example through control of electrical potential ($V_{grid}$) to a grid that controls movement of charges from charging wires to the surface of the recording member as is well known.

At an exposure station 34, projected light from a write head dissipates the electrostatic charge on the photoconductive belt to form a latent image of a document to be copied or printed. The write head preferably has an array of light-emitting diodes (LEDs) or other light source for exposing the photoconductive belt picture element (pixel) by picture element with an intensity regulated by a programmable controller 36 as determined by LCU 24. Alternatively, the exposure may be by optical projection of an image of a document or a patch onto the photoconductor. A still further alternative is creating electrostatic latent images using needle-like electrodes or other known means for forming such latent images.

Where an LED or other electro-optical exposure source is used, image data for recording is provided by a data source 36 for generating electrical image signals such as a computer, a document scanner, a memory, a data network, etc. Signals from the data source and/or LCU may also provide control signals to a writer network, etc. Signals from the data source and/or LCU may also provide control signals to a writer interface 32 for identifying exposure correction parameters in a look-up table (LUT) for use in controlling image density. In order to form patches with density, the LCU may be provided with ROM memory representing data for creation of a patch that may be input into the data source 36. Travel of belt 18 brings the areas bearing the latent charge images into a development station 38. The development station has one (more if color) magnetic brushes in juxtaposition to, but spaced from, the travel path of the belt. Magnetic brush development stations are well known. For example, see U.S. Pat. Nos. 4,473,029 to Fritz et al and 4,546,060 to Miskinis et al.

LCU 24 selectively activates the development station in relation to the passage of the image areas containing latent images to selectively bring the magnetic brush into engagement with or a small spacing from the belt. The charged toner particles of the engaged magnetic brush are attracted imagewise to the latent image pattern to develop the pattern.

As is well understood in the art, conductive portions of the development station, such as conductive applicator cylinders, act as electrodes. The electrodes are connected to a variable supply of D.C. potential $V_B$ regulated by a programmable controller 40. Details regarding the development station are provided as an example, but are not essential to the invention.

A transfer station 46 as is also well known is provided for moving a receiver sheet S into engagement with the photoconductor in register with the image for transferring the image to a receiver. Alternatively, an intermediate member may have the image transferred to it and the image may then be transferred to the receiver. A cleaning station 48 is also provided subsequent to the transfer station for removing toner from the belt 18 to allow reuse of the surface for forming additional images. In lieu of a belt a drum photoconductor or other structure for supporting an image may be used. After transfer of the unfixed toner images to a receiver sheet, such sheet is transported to a fuser station 49 where the image is fixed.

The LCU provides overall control of the apparatus and its various subsystems as is well known. Programming commercially available microprocessors is a conventional skill well understood in the art. The following disclosure is written to enable a programmer having ordinary skill in the art to produce an appropriate control program for such a microprocessor. In lieu of only microprocessors the logic operations described herein may be provided by or in combination with dedicated or programmable logic devices.

Figure 2:
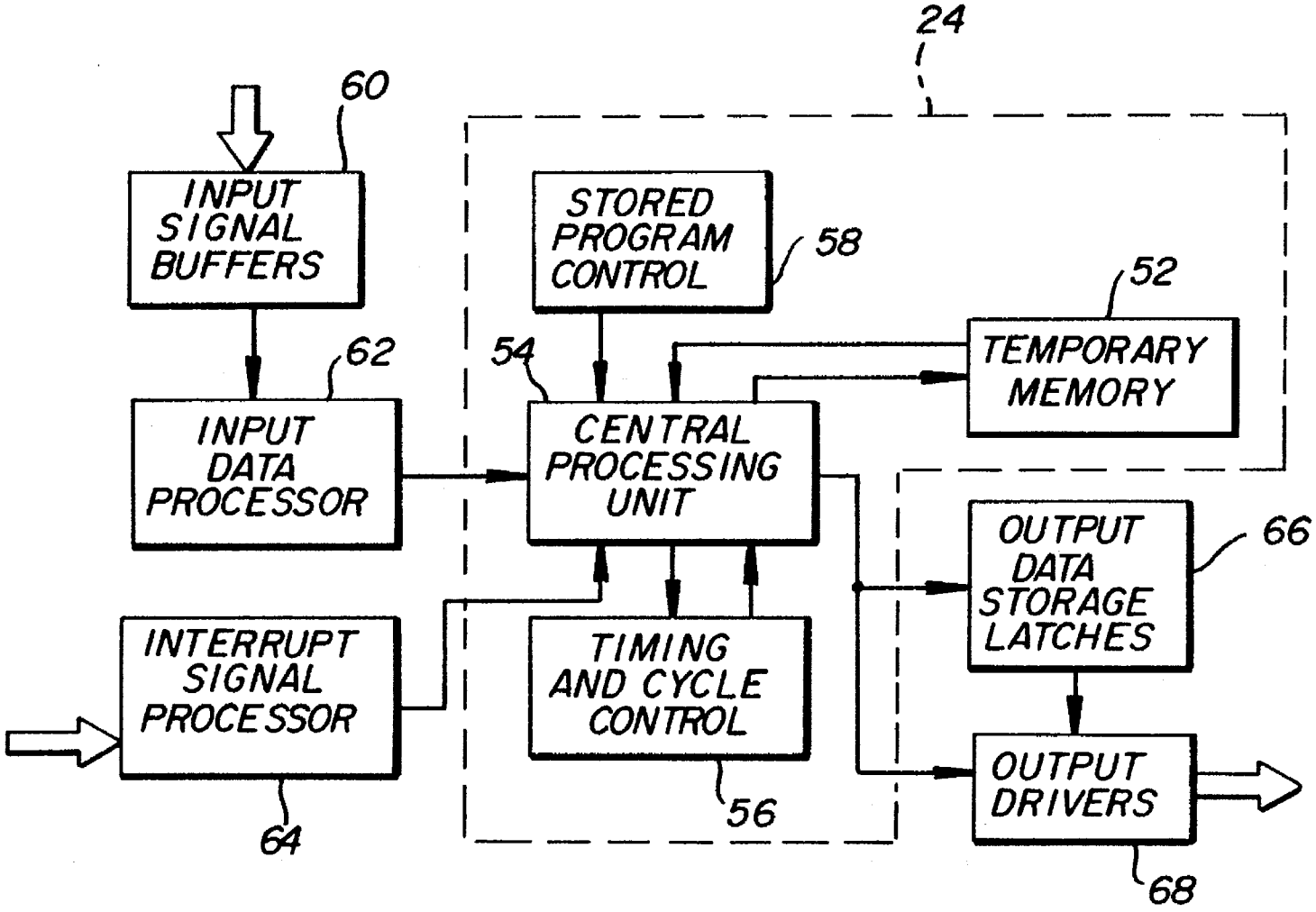
FIG. 2 is a block diagram of the logic and control unit shown in FIG. 1.

Referring to FIG. 2, a block diagram of a typical LCU 24 is shown. The LCU comprises temporary data storage memory 52, central processing unit 54, timing and cycle control unit 56, and stored program control 58. Data input and output is performed sequentially through or under program control. Input data are applied either through input signal buffers 60 to an input data processor 62 or through an interrupt signal processor 64. The input signals are derived from various switches, sensors, and analog-to-digital converters that are part of the apparatus 10 or received from sources external to machine 10.

The output data and control signals are applied directly or through storage latches 66 to suitable output drivers 68. The output drivers are connected to appropriate subsystems.

Process control strategies generally utilize various sensors to provide real-time control of the electrostatographic process and to provide "constant" image quality output from the user's perspective.

One such sensor may be a densitometer 76 to monitor development of test patches in non-image areas of photoconductive belt 18, as is well known in the art. The densitometer is intended to insure that the transmittance or reflectance of a toned patch on the belt is maintained. The densitometer may consist of an infrared LED which shines through the belt or is reflected by the belt onto a photodiode. The photodiode generates a voltage proportional to the amount of light received. This voltage is compared to the voltage generated due to transmittance or reflectance of a bare patch, to give a signal representative of a estimate of toned density. This signal $D_{out}$, may be used to adjust $V_O$, $E_O$, or $V_B$; and, as explained below, to assist in the maintenance of the proper concentration of toner particles in the developer mixture.

In the preferred embodiment, the density signal is used to detect short term changes in density of a measured patch to control primary voltage $V_O$, $E_O$ and/or $V_B$. To do this, $D_{out}$ is compared with a set point density value or signal D (SP) and differences between $D_{out}$ and D(SP) cause the LCU to change settings of $V_{grid}$ on charging station 28 or adjust exposure through modifying exposure duration or light intensity for recording a pixel and/or adjustment to the potential $V_B$ at the development station. These changes are in accordance with values storm in the LCU memory, for example, as a look-up table.

Figure 5:
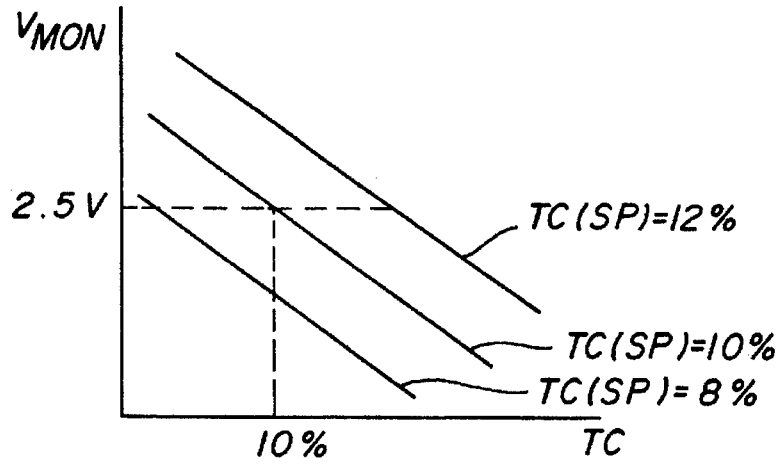
FIG. 5 is a graph illustrating a relationship between toner concentration (TC) and a signal output by a toner concentration monitor in accordance with the embodiment of FIG. 1.

In accordance with the invention, long term changes in toning contrast are compensated by adjustment of the toner concentration (TC) setpoint of a TC controller 57. The TC controller, in turn, adjusts the short term rate of toner replenishment. In a two-component developer provided in development or toning station 38, toner gets depleted with use whereas magnetic carrier particles remain thereby affecting the toner concentration in the development station. Addition of toner to the development station may be made from a toner replenisher device 39 that includes a source of toner and a toner auger for transporting the toner to the development station. A replenishment motor 41 is provided for driving the auger. A replenishment motor control circuit 43 controls the speed of the auger as well as the times the motor is operating and thereby controls the feed rate and the times when toner replenishment is being provided. Typically, the motor control 43 operates at various adjustable duty cycles that are controlled by a toner replenishment signal TR that is input to the replenishment motor control 43. Typically, the signal TR is generated in response to a detection by a toner monitor of a toner concentration that is less than that of a set point value. For example, a toner monitor probe is a transducer that is located or mounted within or proximate the development station and provides a signal related to toner concentration. This signal is input to a toner monitor which in a conventional toner monitor causes a voltage signal $V_{MON}$ to be generated in accordance with a predetermined relationship between $V_{MON}$ and TC (see FIG. 6). The voltage $V_{MON}$ is then compared with a fixed voltage of say 2.5 volts which would be expected for a desired toner concentration of say 10%. Differences of $V_{MON}$ from this fixed voltage are used to adjust the rate of toner replenishment or the toner replenishment signal TR. In a more adjustable type of toner monitor such as one manufactured by Hitachi Metals, Ltd., the predetermined relationship between TC and $V_{MON}$ offers a range of relationship choices. With reference to FIG. 5, a particular parametric relationship between TC and $V_{MON}$ may be selected in accordance with a voltage input representing a toner concentration set point signal value, TC(SP). Thus changes in TC(SP) can affect the rate of replenishment by affecting how the system responds to changes in toner concentration that is sensed by the toner monitor. The generation of the signal TC(SP) and how it affects the toner replenishment in accordance with the invention will now be described.

Figure 3:
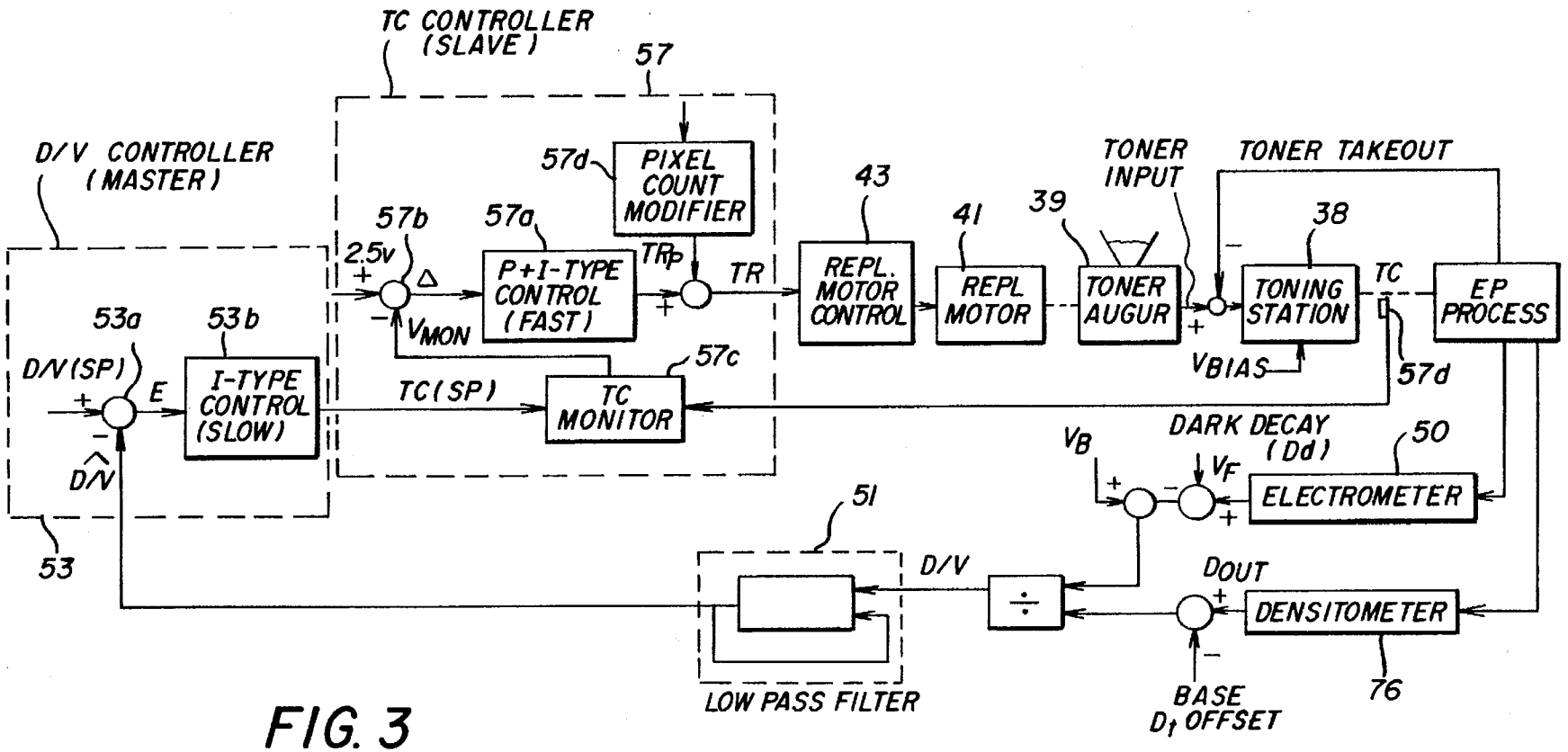
FIG. 3 is a block diagram of a process for deriving a development station replenishment control signal for the electrostatographic machine of FIG. 1.
Figure 4A:
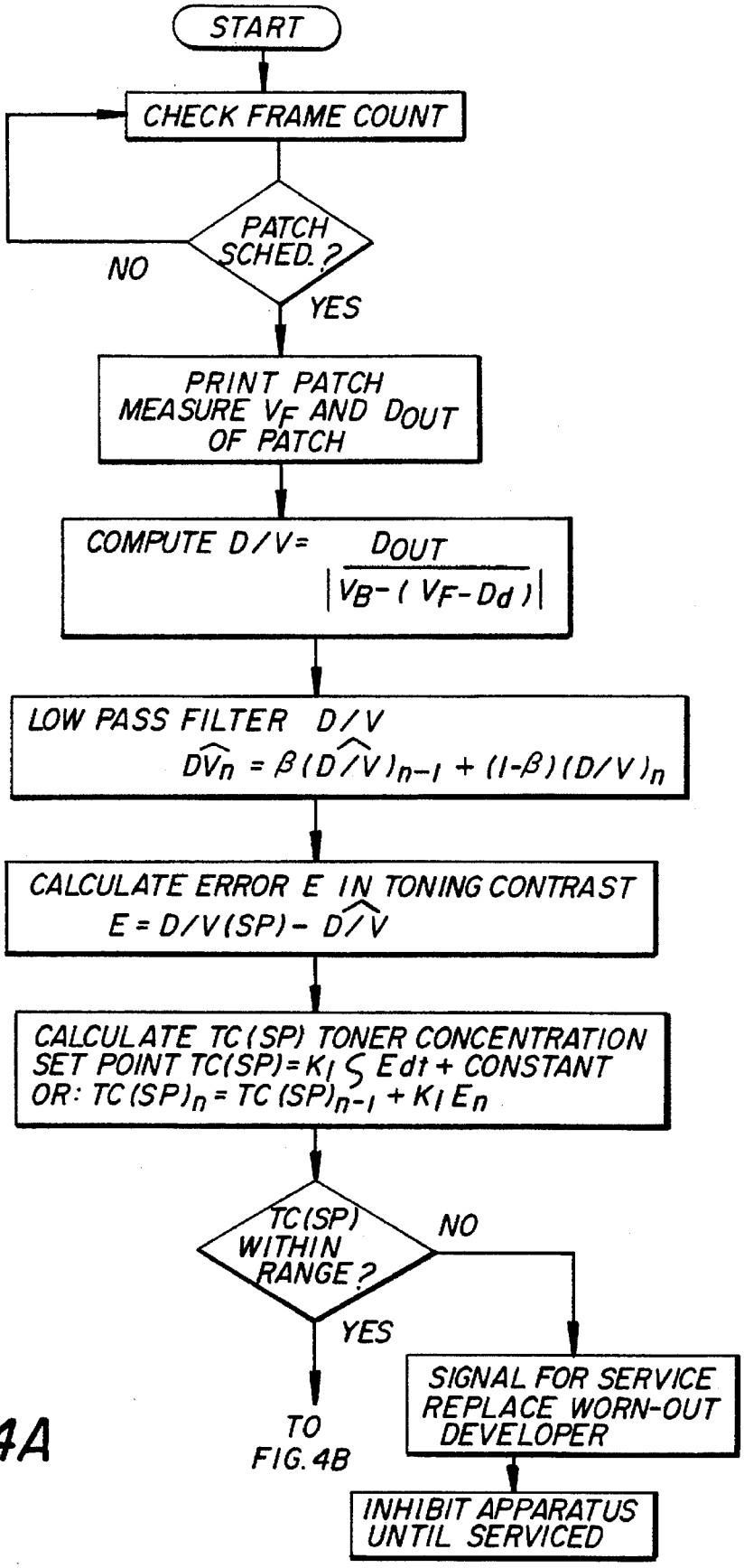

With reference now to FIGS. 1, 3 and the flowchart of FIGS. 4A and 4B, the LCU is programmed to periodically enter a patch creation mode wherein a patch of predetermined nominal density is formed; i.e., by exposure and development with toner on the web preferably in an interframe area. After the patch is exposed, the charge remaining on the exposed area of the patch prior to development is measured by an electrometer 50 which generates a signal $V_F$ or, as noted above, $V_F-D_d$. The density of the patch $D_{OUT}$ (preferably transmission density) after development of the patch is measured and used to adjust $V_O$, $V_B$, etc. as noted above but is also used to determine the value of toning contrast (D/V) for the creation of this patch. Note that measured $D_{out}$ also may be adjusted for transmission losses of light used to measure $D_{out}$ and caused by the passing of this light through the web. Generally, the value D/V may be computed as $D_{out}/|V_B-V_F|$ A more precise value of D/V may instead be calculated by considering dark decay. Thus, in considering dark decay $D/V=D_{out}/|V_B-(V_F-D_d)|$. For each patch several values of toning contrast are generated based on reading of different potions of the patch so that a signal representing such values may be averaged before being passed through a low pass filter 51. The filter 51 may operate on the present toning contrast signal for the current patch in accordance with a relationship wherein the output of the filter 51 $\widehat{D/V}_n=\beta(\widehat{D/V})_{n-1}+(1-\beta)(D/V)_n$; wherein $(\widehat{D/V})_{n-1}$ represents a filtered value of toning contrast for the prior patch and $(D/V)_n$ represents toning contrast calculated for the current patch preferably as an average for the patch. The value $\beta$ is a constant that may be set between 0 and 1. Typically, where large process or measurement noises adversely affect the computed toning contrast, $\beta$ will be closer to 1. For the initial calculation of $\widehat{D/V}$, $\beta=0$.

The output of the filter 51 is a signal representing a filtered value of toning contrast D/V, which is then compared with a set point value for toning contrast D/V(SP) that is determined experimentally. The value D/V(SP) may be a constant or a value that changes with age of the developer mix and/or relative humidity (RH). Where it is made to change a look-up table may be associated with the LCU for changing D/V(SP) with the parameters of developer age or RH. A difference between the two values represents an error E and this error is integrated over time by an integral controller or integral control algorithm operating as an integral controller. The integral controller is tuned or set to provide a relatively slow response at its output in response to signals at its input. A comparator **53*a* for generating the error signal E and the integral controller 53*b* form a first stage of a two-stage cascaded control for generating the toner replenishment signal. The first stage 53 provides an output signal representing a toner concentration set point signal TC (SP) that is input to the toner concentration monitor of a type having characteristics similar to that of FIG. 5**.

In order to clarify the above-described steps, example calculations will be shown beginning with the exposure of a patch and continuing through the adjustment in TC(SP), in response to the electrometer and densitometer readings of that patch. Patches are exposed at intervals as scheduled in the LCU. The scheduled patches may be at fixed print intervals or at variable intervals according to the rest/run history just prior. Patches may be written at shorter intervals during start-up after a long rest, so that more frequent patch measurements can be taken during such a start-up phase, when imaging characteristics such as toning contrast tend to change rapidly. More frequent process adjustments to $V_O$, $V_B$, and E, for example, may then be computed from the more frequent measurements, as may be required to precisely compensate for the fast-changing imaging characteristics. After a patch is exposed, it passes the electrometer 50 which generates a signal $V_F$. Suppose, for example, that a $V_F$ signal represents a surface potential on the belt 18 of 200 volts. Note this may be an average of more than one reading of this particular patch. The nominal dark decay, $D_d$, occurring during the transit time from the electrometer to the toning station has been previously determined to be, say, 5.0 volts and this value is saved in the LCU. The patch surface potential when it reaches the toning zone is therefore estimated as 200−5=195 volts, in this example. After the electrometer measurement, the patch is toned by the development station. Let us assume that the bias voltage on the development station in this example is $V_B$=400 volts. After toning, the patch passes the densitometer 76. The gross transmission densitometer reading for the toned patch is say 4.0 volts. Suppose further that the densitometer reading for this area of the belt without toner has been previously measured as 1.0 volts, and saved in the LCU. The net toner density of the patch is then computed as 4.0−1.0=3.0 volts. The toning contrast, D/V is then computed for this patch as 3.0/(400−(200−5))=3.0/205=0.0146.

To smooth the effects of random measurement noise, this value is input to a low-pass filter calculation to generate a filtered calculation of D/V, designated $\widehat{D/V}$. Suppose that the previous calculation of $\widehat{D/V}$ or $(\widehat{D/V})_{n-1}$ was 0.0150, and that the filter factor $\beta$=0.75. The new value is then computed as $\widehat{D/V}=0.75\times0.0150+(1-0.75)\times0.0146=0.0149$. Suppose the desired value for $\widehat{D/V}$ is D/V(SP)=0.0145. The error is computed as E=0.0145−0.0149=−0.0004. This negative error indicates that currently D/V is slightly high (because of long-term aging or possibly other, short-term effects).

The error E is input to the "master" controller **53*b*** of the integral type which computes an adjusted TC(SP). The integral type controller, for simplicity of calculation purposes, may operate in accordance with the following equation $TC(SP)n=TC(SP)n-1+K_1En$. Suppose that the previous value of TC(SP) was 10% and that the gain constant $K_1$=2.0. The new TC(SP) or TC(SP)n is computed as $TC(SP)n=10+2.0\times(-0.0004)=9.9992$. The value of $K_1$ is small, so that individual adjustments $K_1\times E$ are small for reasonable E values. Cumulative adjustments over short-term changes in environment and duty cycle are also small. But over the long-term, cumulative changes may be large (up to several % TC) as the developer ages. The numerical value required for $K_1$ will depend upon the frequency of adjustment (patch frequency). In our example, the TC adjustment is $K_1\times E=-0.0008\%$ TC. This one adjustment is not a significant change in TC(SP). However, suppose the value of E=−0.0004 (on average) persists over several days and 1000 patches. The 1000 patches might represent, say, 100,000 prints at an average patch frequency of 1 patch every 100 prints. Then, the cumulative adjustment would be −0.8% TC, which is a small but significant change over this period, and would tend to counteract the effects of aging.

The signal TC(SP) thereby serves to determine which line or curve of FIG. 5 is used to establish a predetermined relationship between an output signal $V_{MON}$ from the toner concentration monitor **57*c* and an input signal to the monitor from the TC monitor's probe 57d. While only three lines are illustrated in FIG. 5, it should be understood that there could be many more lines or even a continuum of such lines. Print-to-print changes in toner usage relative to replenishment can cause TC to change quickly, producing rapid changes in the $V_{MON}$ signal. The signal $V_{MON}$ is compared by a comparator 57b with a constant of say 2.5 V and a difference signal Δ is input to a proportional plus integral (P+I) type controller 57a or algorithm that operates as such a controller. The P+I controller is tuned for a relatively fast response to input signals Δ. Like $V_{MON}$, Δ may change quickly owing to print-to-print variation in toner usage. The output from the P+I controller 57a represents a preliminary toner replenishment signal TRp. The signal TRp may be modified with a signal that provides adjustment for toner take out based on pixel count. Where the exposure system relies on electro-optical exposure of the photoconductive belt the take out of toner will be related to the number of pixels exposed, assuming that this is a discharged area development process. Where the electro-optical exposure source is of a gray level or multibits per pixel, the count signal may keep track of accumulating grey level exposures and weigh the count accordingly so as to be related to toner take out. The use of pixel counting to modify a toner replenishment signal is known as discussed above and is considered to be optional to the process and apparatus of this invention. The TC monitor comparator 57b, P+I controller 57a and pixel count modifier 57d** form the second or slave stage of the two-stage cascaded feedback control system which is used to generate the toner replenishment signal TR. For simplicity of calculations, the P+I controller may operate according to the equation $$TR_{pn}=TR_{p(n-1)}+K_2(\Delta_n-\Delta_{(n-1)})+K_3\Delta_n$$

wherein $TR_{pn}$ is the current preliminary toner replenishment signal, $TR_{p(n-1)}$ is the previously calculated preliminary toner replenishment signal, $\Delta_n$ is the current difference between $V_{MON}$ and 2.5, $\Delta_{(n-1)}$ is the previously calculated difference between $V_{MON}$ and 2.5, and $K_2$ and $K_3$ are constants.

The best values for $K_2$ and $K_3$ depend on the TC monitor sensitivity S, and the replenisher gain G, which can be ascertained by the methods described below. For best TC regulation in a given configuration, $K_2$ and $K_3$ can be set so that the overall gain products $K_2SG$ and $K_3SG$ are predetermined optimal values determined experimentally or through simulation methods.

Figure 6:
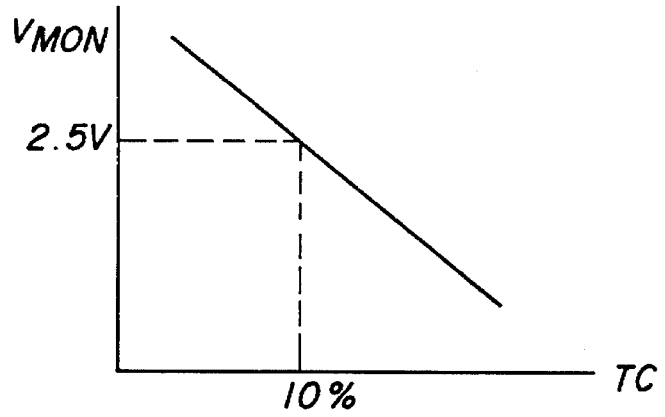
FIG. 6 is a similar graph to that of FIG. 5 but represents a relationship between TC and a signal output by a TC monitor in accordance with another embodiment of the invention.

The method and apparatus described may also be used with a toner monitor of the type having a characteristic of that illustrated in FIG. 6; i.e., a fixed parametric relationship is provided between $V_{MON}$ and measured TC. Where such a toner monitor is used the signal of TC(SP) output from the D/V master controller 53 is input into one input of comparator 57b in lieu of the constant signal of 2.5 volts and thus TC(SP) is compared with $V_{MON}$ to generate the signal Δ.

The apparatus described thus provides a cascaded two stage feedback control system for generating a toner replenishment signal. The master portion of the system is a toning contrast feedback controller that operates on changes in toning contrast from a set point to generate a toner concentration set point signal. A second part of the cascaded feedback control system or slave portion involves feedback of toner concentration measurements and generation of a toner replenishment signal by a slave feedback controller that is responsive to the output of the master toning contrast controller 53 and the feedback signal of the toner concentration. The control system described may be implemented either by hardware and/or a suitably programmed computer or microcomputer.

The above-described method and apparatus provides for improved regulating of toning contrast (D/V). At intervals, process control patches are exposed and toned so that an on-board electrometer and an on-board transmission densitometer can read $V_F$ and $D_{out}$, respectively. With the known $V_B$, D/V can then be computed in the machine LCU, and compared to the desired value for D/V. Since there is a direct relationship between TC and D/V, the TC setpoint of the replenishment algorithm is adjusted according to the error in D/V. However, the rate of adjustment of the TC setpoint is limited such that the change in TC is very gradual over developer age. With this limitation, the TC does not change significantly over relatively short-term variations in environment or duty-cycle. The short-term variations in density are rather compensated by immediate adjustments in, for example, charging and/or exposure, while long-term changes are compensated by the gradual adjustment of TC.

One advantage of the above method of D/V regulation is that the burden of process control adjustments is shared in a way that avoids the problems that occur when any one adjustment is changed by an extreme amount. The short-term affects are compensated immediately by adjustments in charging and/or exposure and toning station $V_B$. The longer term effects, owing to developer age, are compensated by regulating D/V. With age, developers tend to decrease in charge-to-mass ratio (Q/M), and increase in toning contrast (D/V). To compensate for this aging effect, TC is gradually decreased, and D/V is maintained constant, except for the short-term fluctuations. By avoiding the extremes in replenishment which would be required to rapidly change TC, the developer mix tribocharges more consistently and dusting is minimized.

A further advantage is that the gradually decreasing TC tends to slow or delay the decrease in Q/M with age, keeping dust and background reasonably low for a longer time. Two-component developers in general display aging behavior of the triboelectric charging ability of the carrier, in that charging rate and equilibrium charge level decrease with usage. The physical cause is usually scumming of the carrier surface with the toner material. Decreasing TC enhances the rate of charging, counteracting the effects of aging. Therefore, the developer need not be replaced until much later, compared to operating at a fixed TC throughout developer life.

Figure 8:
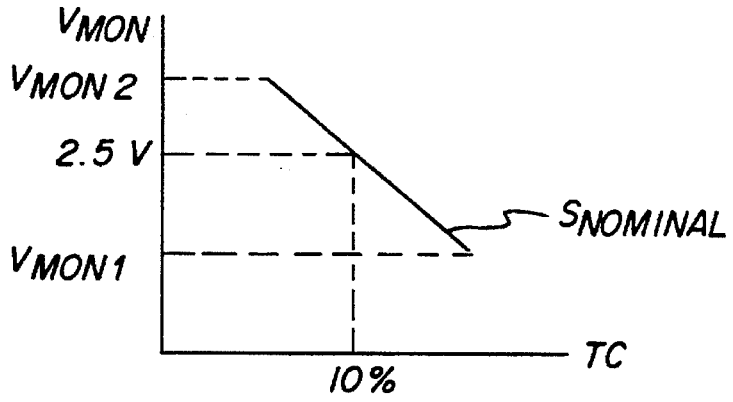
FIG. 8 PRIOR ART
FIG. 8 is a graph illustrating a relationship between TC and a signal output by a TC monitor in accordance with the prior art.
Figure 7:
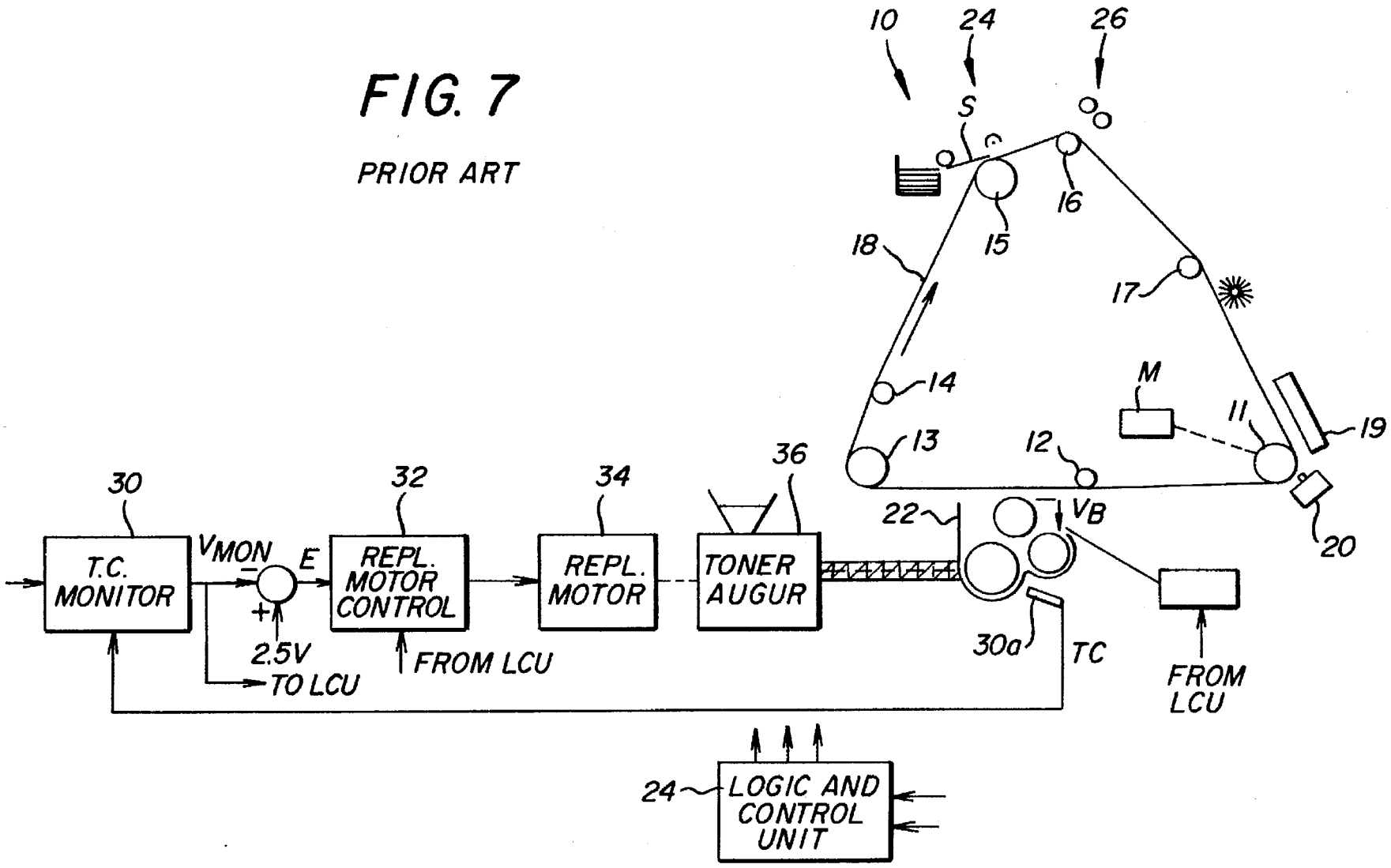
FIG. 7 PRIOR ART
FIG. 7 is a schematic showing a side elevational view of an electrostatographic machine as known in the prior art.
Figure 7:
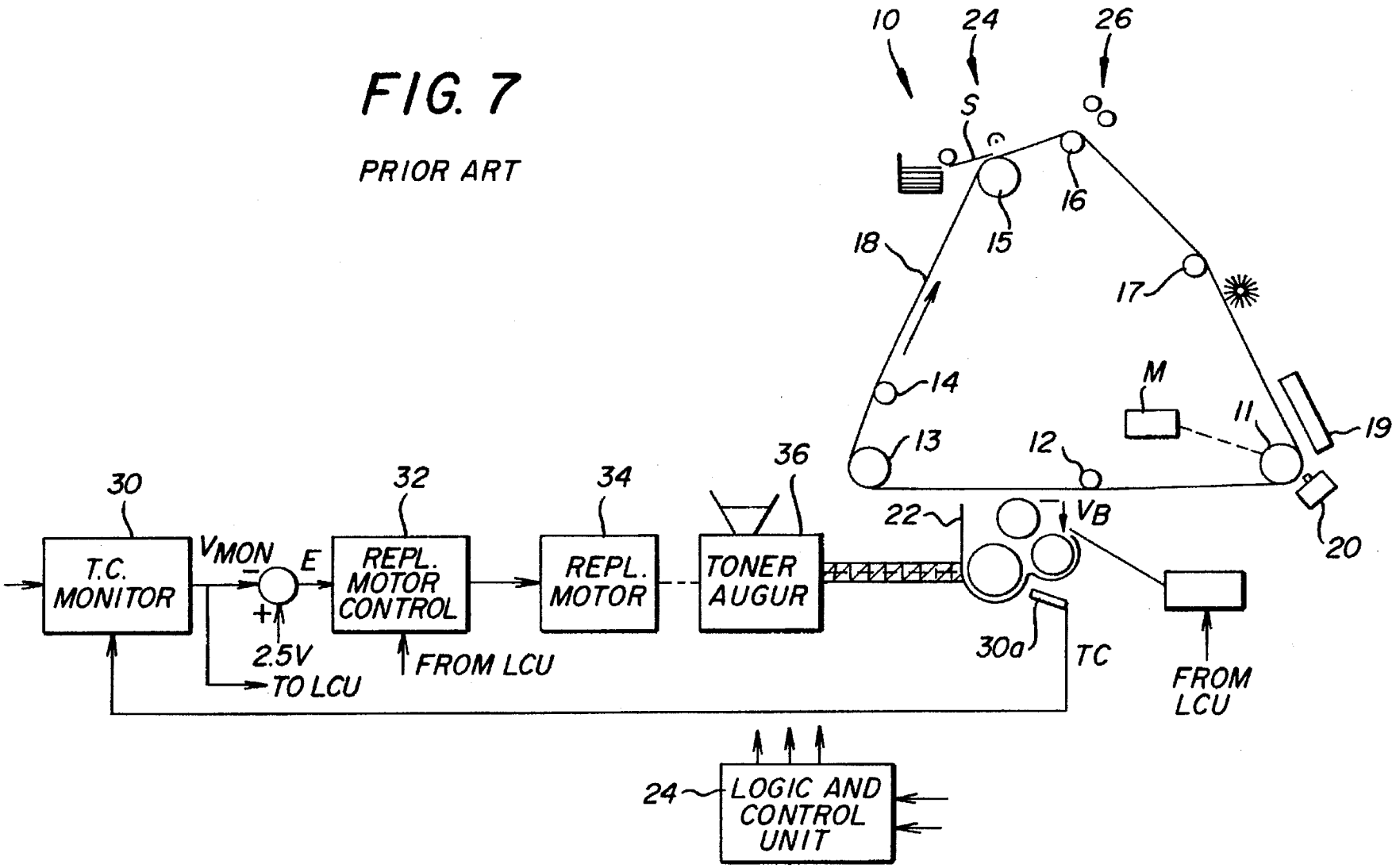
FIG. 7 PRIOR ART
Figure 9:
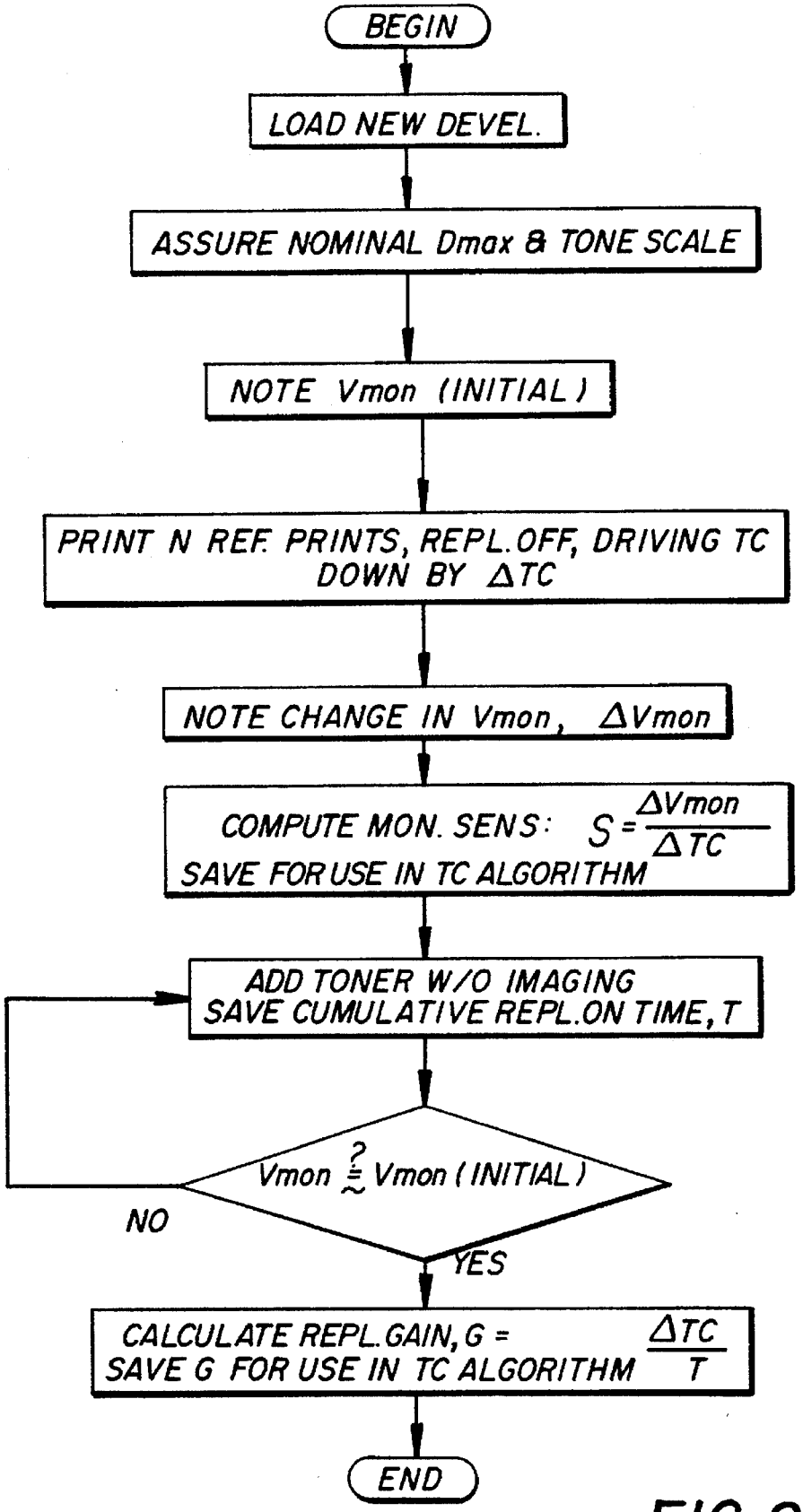
FIG. 9 is a flowchart of a process for in-station calibration of a TC monitor and a replenisher drive in accordance with the invention.

As noted above, the parametric relationship between TC and $V_{MON}$ illustrated in FIG. 8 is generally based on nominal assumptions based either on data from the manufacturer or experience with toner monitors in general. In accordance with the improved method of the invention and with reference to FIG. 9, further improved TC control is obtained by reducing the uncertainty in toner concentration monitor sensitivity and in replenisher gain. Replenisher gain is related to control of the auger feed and involves weight of toner delivered per unit on time of the auger. In accordance with the improved method, the development station is loaded with a known weight of fresh developer and the percent of TC is also known. Preferably, the initial toner concentration is made to be the same as the desired TC(SP). The probe of the toner monitor is mounted on or in the development station in its position for normal use. The initial monitor output voltage $V_{MON}$ is noted by the machine logic. A check is made of the imaging by the usual methods, assuring that the copier or printer is set up to produce normal $D_{max}$ and tone scale. Then, a first calibration run is made that depletes a predetermined weight of toner from the development station. In this run a standard reference print of known toner usage per print is printed for a predetermined number of prints, using up a known weight of toner from the development station, and reducing the TC by a known percent. No replenishment is done during this first calibration run. The difference in monitor output voltage $V_{MON}$ is noted by the machine logic between the beginning and end of this first calibration run. The logic then computes monitor sensitivity in volts per % change in TC.

The replenisher gain is calibrated in a second calibration run, immediately following the first calibration run that was used for determining monitor sensitivity. Without toning any images, the replenisher 39 is actuated. Toner is delivered, a little at a time, to the toning station where it is mixed uniformly into the developer. The monitor output voltage $V_{MON}$ changes as TC builds up. When $V_{MON}$ reaches the value noted initially at the start of the first calibration run, the TC is again at the initial nominal value. The weight of toner used (and then replenished) and the change in TC resulting is predetermined by the number of reference prints. The machine logic computes the replenisher gain, G, as the change in TC divided by the total replenisher 'ON' time. The replenisher gain, G, is saved for use in determining the overall gain products of the feedback system as described above.

Thus, with the improved calibration method of the invention, various advantages are provided. Threshold values for fault detection (high TC or low TC) can be accurately set in terms of % TC rather than monitor output voltage. The closed-loop control algorithm gain can be adjusted to compensate variation in unit-to-unit TC monitor sensitivity and/or replenisher gain. The product of monitor gain times algorithm gain times replenisher gain can be optimized for tightest TC regulation. Where pixel count (open-loop) replenishment is provided, replenishment is more accurate when the replenisher gain is accurately known. In-station calibration as described herein accounts for variability in mounting of the TC monitor probe as well as the TC monitor unit variability from unit to unit. Tolerances on TC monitor nominal sensitivity, probe and mounting, and replenisher gain may be relaxed.

The invention has been described in detail with particular reference to preferred embodiments thereof, but it will be understood that variations and modifications can be effected within the spirit and scope of the invention.

I claim:

1. A method of determining a sensitivity parameter of a toner monitor that forms a part of an electrostatographic recording apparatus having a development station that includes a mixture of a toner material in a toner developer composition wherein concentration of the toner material in the composition tends to change with use of the apparatus in making copies or prints, the method comprising:

(a) providing in the development station a known weight or concentration of toner material as an initial condition of weight or concentration of toner material;

(b) generating a first signal representing a first output voltage of the toner monitor for the initial condition of weight or concentration of toner material;

(c) operating the electrostatographic recording apparatus in a recording mode wherein the predetermined weight or concentration of toner material in the development station is reduced by a predetermined amount;

(d) generating a second signal representing a second output voltage of the toner monitor for the recording mode; and (e) calculating a sensitivity parameter of the toner monitor in response to the first signal and the second signal.

2. The method of claim 1 in combination with a method of determining gain of a toner replenishment device that forms a part of said apparatus, the method of determining gain comprising the steps of:

(f) after at least step (c) operating the toner replenishment device to deliver toner to the development station without toning any images;

(g) determining the time of operation of the toner replenishment device required to generate a third output voltage of the toner monitor equal to the first output voltage; and (h) calculating gain of the toner replenishment device by dividing the predetermined amount by said time.

3. The method of claim 2 and wherein the sensitivity parameter is calculated by dividing a difference between the first output voltage and the second output voltage by the predetermined amount.

4. The method of claim 2 and wherein in the recording mode plural reference prints are made.

5. The method of claim 1 and wherein the sensitivity parameter is calculated by dividing a difference between the first output voltage and the second output voltage by the predetermined amount.

6. The method of claim 1 and wherein in the recording mode plural reference prints are made.

7. A method of determining a gain parameter of a toner replenishment device that forms a part of an electrostatographic recording apparatus having a development station that includes a mixture of a toner material in a toner developer composition wherein concentration of the toner material in the composition tends to change with use of the apparatus in making copies or prints and wherein concentration of the toner material in the composition is monitored by a toner monitor, the method comprising:

(a) providing in the development station a known weight or concentration of toner material as an initial condition of weight or concentration of toner material;

(b) generating a first signal representing a first output voltage of the toner monitor for the initial condition of weight or concentration of toner material;

(c) operating the electrostatographic recording apparatus in a recording mode wherein the predetermined weight or concentration of toner material in the development station is reduced by a predetermined amount;

(d) operating the toner replenishment device to deliver toner to the development station;

(e) determining the time of operation of the toner replenishment device required to generate a third output voltage of the toner monitor equal to the first output voltage; and (f) calculating gain of the toner replenishment device by dividing the predetermined amount by said time.

8. The method of claim 7 and wherein in the recording mode plural reference prints are made.

9. The method of claim 8 and wherein step (d) is performed after step (c).

10. The method of claim 7 and wherein step (d) is performed after step (c).

* * * * *